United States Patent [19]

Born et al.

[11] 4,056,041

[45] Nov. 1, 1977

[54] CONTROL SYSTEM FOR AXIAL PISTON FLUID ENERGY TRANSLATING DEVICE

[75] Inventors: Ellis H. Born; William H. Meisel; Alan H. Viles, all of Columbus, Ohio

[73] Assignee: ABEX Corporation, New York, N.Y.

[21] Appl. No.: 662,300

[22] Filed: Mar. 1, 1976

Related U.S. Application Data

[62] Division of Ser. No. 494,677, Aug. 2, 1974, Pat. No. 3,967,541.

[51] Int. Cl.[2] ..... F15B 9/10; F16K 1/6; F16K 51/00

[52] U.S. Cl. ..... 91/375 R; 91/3; 91/376 A; 137/625.21; 251/298; 251/286

[58] Field of Search ..... 91/3, 376 A, 375 R, 91/429; 137/625.21, 625.46, 246, 246.12, 246.22; 251/298, 286

[56] References Cited

U.S. PATENT DOCUMENTS

| | | | |
|---|---|---|---|
| 1,116,975 | 11/1914 | Bergesen | 91/375 R |
| 1,208,556 | 12/1916 | Helmholtz et al. | 91/375 R |
| 1,910,600 | 5/1933 | Fitch | 91/375 R |
| 2,989,082 | 6/1961 | Roy | 137/625.46 |
| 3,733,963 | 5/1973 | Kubilos | 91/3 |

FOREIGN PATENT DOCUMENTS

| | | | |
|---|---|---|---|
| 500,840 | 2/1939 | United Kingdom | 91/375 R |

*Primary Examiner*—Paul E. Maslousky
*Attorney, Agent, or Firm*—Thomas S. Baker, Jr.; David A. Greenlee

[57] ABSTRACT

A variable displacement axial piston pump has a rocker cam for controlling the output of the pump. The rocker cam is driven by a fluid motor member. A valve with a follow-up device regulates pressure fluid flow to the fluid motor member to move the rocker cam. Both the fluid motor member and a part of the follow-up device are rigidly secured to and movable with the rocker cam to provide precise positioning of the rocker cam.

10 Claims, 9 Drawing Figures

CONTROL SYSTEM FOR AXIAL PISTON FLUID ENERGY TRANSLATING DEVICE

This is a division of application Ser. No. 494,677 filed Aug. 2, 1974, now U.S. Pat. No. 3,967,541.

BACKGROUND OF THE INVENTION

I. Field of the Invention

The instant invention relates generally to variable displacement axial piston type fluid energy translating devices and more specifically to the control devices therefor.

II. Description of the Prior Art

A common type of axial piston fluid energy translating device is a pump or motor which includes a housing having a rotatably mounted barrel with a plurality of circumferentially spaced cylinder bores. A port plate is interposed between the barrel and the inlet and working ports of the device to alternately connect each cylinder with the inlet and working ports of the device as the barrel is rotated. Within each bore is a piston which is connected by shoes to a pivotable rocker cam assembly which reciprocates the pistons to pump fluid as the barrel is rotated.

In one form of variable displacement axial piston pump, the rocker cam assembly is pivoted about an axis perpendicular to the axis of rotation of the barrel to vary the inclination of the thrust plate assembly. This changes the stroke of the pistons and consequently changes the displacement of the pump. In such pumps, a control device is provided to vary the inclination of the rocker cam.

In U.S. Letters Pat. No 3,739,691 to Bobier, a variable displacement axial piston pump is shown with a rocker cam assembly on a pivotable yoke. As the yoke pivots, the rocker cam assembly is pivoted with respect to the cylinder barrel to change the stroke of the pistons. An L-shaped arm on the yoke has a slot which engages a connecting pin. This pin is connected to a displacement control device.

In one embodiment shown in the Bobier patent, the displacement control device is a piston mounted in a housing bore and positioned by a thumbscrew.

In another embodiment shown in the Bobier patent, the yoke has a pair of transverse control arms each engaged by a pair of opposed movable pistons.

U.S. Letters Pat. No. 2,945,449 to Le Febvre et al shows a rocker cam assembly on a tilt block having a convex back which rides upon opposed pairs of rollers.

The displacement control device shown in the Le Febvre patent is a spring centered hydraulic piston which is connected to the rocker cam by a mechanical linkage. The piston is operated by a hydraulic control valve which includes a follow-up mechanism. Another prior art displacement control device is shown in U.S. Pat. No. 3,302,585.

In such prior art control mechanisms, the displacement control device is connected to the rocker cam by a mechanical linkage. A disadvantage of such mechanisms is the inherent tolerances in mechanical linkage which may cause free play and may make precise positioning of the rocker cam difficult. Further, the amount of free play may increase as the linkage wears.

SUMMARY OF THE INVENTION

The present invention departs from these and other prior art devices by providing an axial piston type pump or motor (generically referred to as a variable displacement fluid energy translating device) having a rocker cam and a novel control mechanism for positioning the rocker cam.

According to the principles of the invention, the control mechanism includes a movable fluid motor member and a follow-up valve member, each of which is rigidly secured to and movable with the rocker cam. This arragement and the structural details thereof are believed to produce a precision of adjustment and reliability of operation previously unknown in the art.

DESCRIPTION OF THE DRAWINGS

These and other features and advantages of the present invention are incorporated in the presently preferred embodiment of the invention shown in the drawings, wherein.

DESCRIPTION OF THE PREFERRED EMBODIMENT

In a fluid energy translating device, one port is designated the low pressure port and the other port is designated the high pressure or working port. If a prime mover drives the device such that low pressure fluid is supplied and high pressure fluid is exhausted, the device is commonly referred to as a pump. If, however, high pressure fluid is supplied to operate the device and low pressure fluid is exhausted, it is commonly referred to as a motor. To facilitate this description, the device will hereinafter be referred to as a pump.

Figure 1:
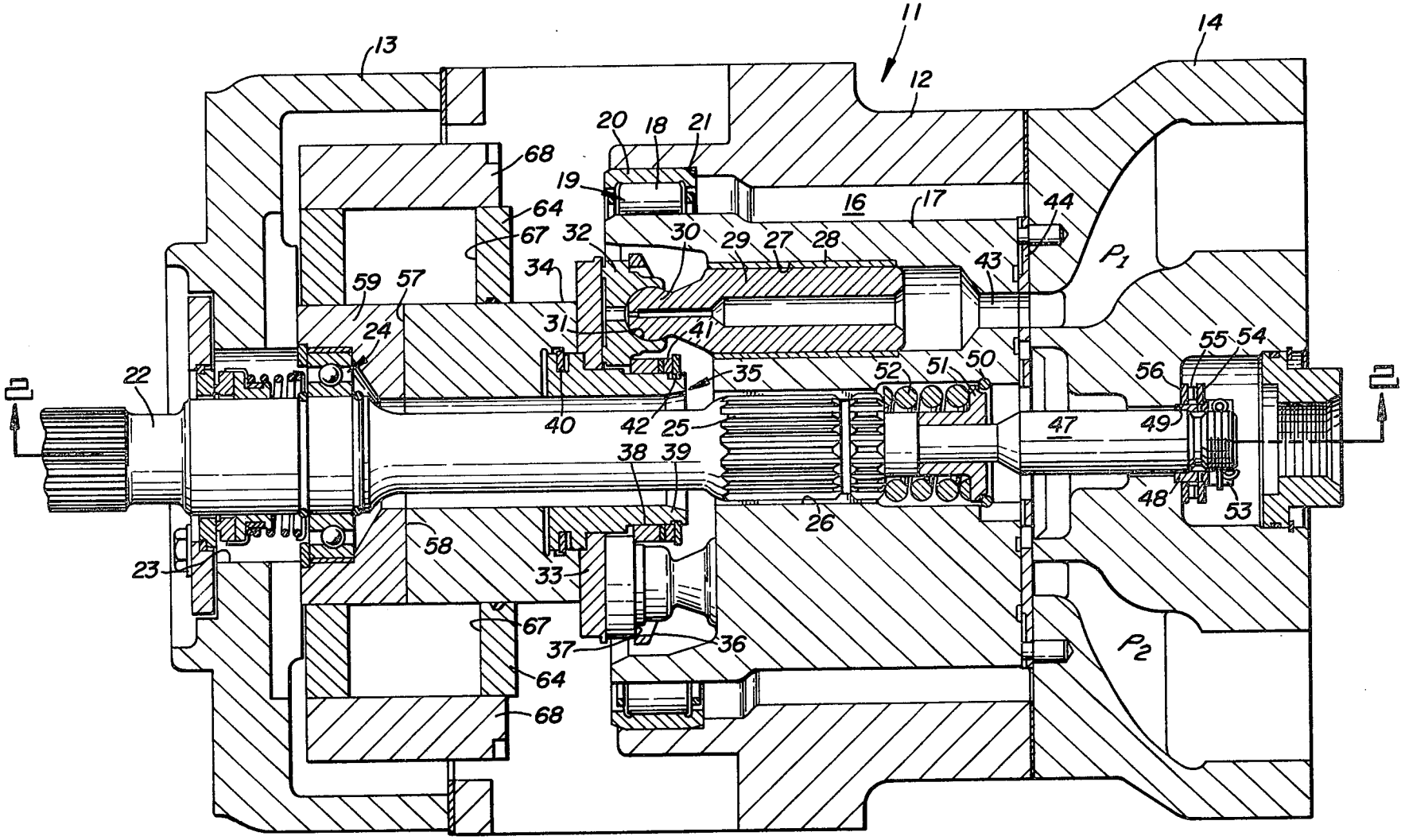
FIG. 1 is an axial sectional view of a fluid energy translating device according to the instant invention taken along line 1—1 of FIG. 2.
Figure 2:
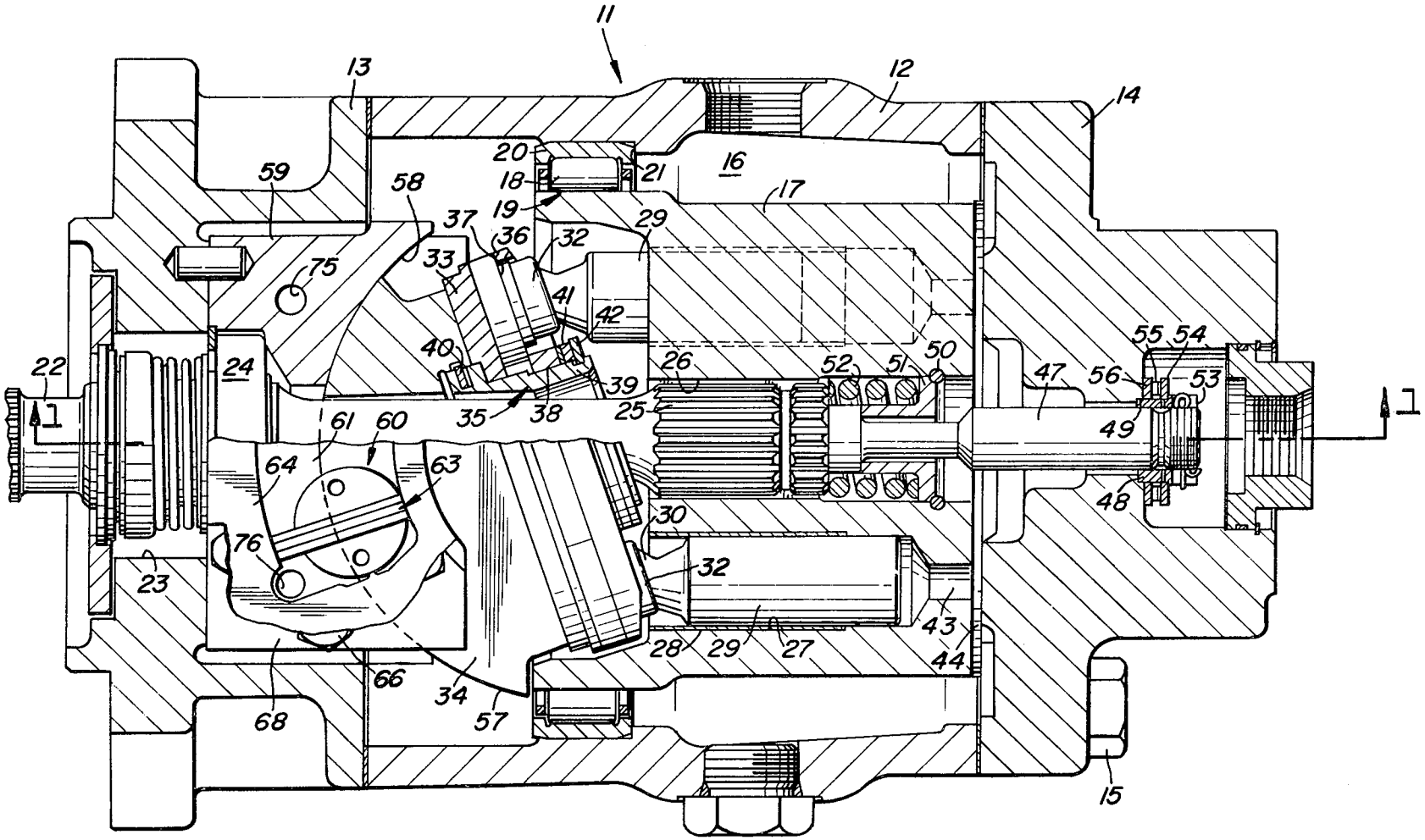
FIG. 2 is an axial sectional view of the fluid energy translating device according to the instant invention taken along line 2—2 of FIG. 1.

Referring now to FIGS. 1 and 2, an axial piston pump is shown having a case 11 which includes a central housing 12, an end cap 13 at one end thereof and a port cap 14 at the other end. Case 11 is fastened together by bolts 15.

Case 11 has a cavity 16 in which a rotatable cylinder barrel 17 is mounted on rollers 18 of a bearing 19 which has its outer race 20 pressed against a housing shoulder 21. A drive shaft 22 passes through a bore 23 in end cap 13 and is rotatably supported in a bearing 24. The inner end 25 of drive shaft 22 is drivingly connected to a central bore 26 in barrel 17.

Barrel 17 has a plurality of bores 27 equally spaced circumferentially about the rotational axis of the barrel 17. A sleeve 28 in each bore 27 receives a piston 29. Each piston 29 has a ball-shaped head 30 which is received in a socket 31 of a shoe 32.

Each shoe 32 is retained against a flat creep or thrust plate 33 mounted on a movable rocker cam 34 by a shoe retainer assembly 35. Assembly 35 includes a shoe retainer plate 36, with a number of equally spaced bores equal to the number of pistons 29, which passes over the body of each piston and engages a shoulder 37 on each shoe 32. The shoe retainer plate 36 has a central bore 38 which passes over a post 39 affixed to rocker cam 34 by a snap ring 40. A spacer 41 is interposed between the shoe retainer plate 36 and a snap ring 42 which secures the shoe retainer plate 36 on the post 39 and prevents the shoes 32 from lifting off of thrust plate 33.

Each cylinder bore 27 ends in a cylinder port 43 which conducts fluid between a port plate 44 and the bore 27. Port plate 44 is positioned between barrel 17 and port cap 14. A pair of kidney-shaped apertures, not shown, are formed in the plate 44. These apertures communicate with ports $P_1$, $P_2$ in the port cap 14. One of the ports contains low pressure fluid and is the intake port while the other port contains high pressure or working fluid and is the exhaust port, depending upon the operating conditions of the pump.

Referring again to FIGS. 1 and 2, rotation of drive shaft 22 by a prime mover such as an electric motor, not shown, will rotate cylinder barrel 17. Rocker cam 34 pivots about an axis which intersects the axis of rotation of the barrel and which is perpendicular to the axis. If rocker cam 34 and thrust plate 33 are inclined from a neutral position normal to the axis of shaft 22, the pistons 29 will reciprocate as the shoes 32 slide over the plate 33. As the pistons 29 move away from the port plate 44, low pressure fluid is received into the cylinder bores 27. As the pistons move toward the port plate 44, they expel high pressure fluid into the exhaust port.

Rotation of cylinder barrel 17 rotates a barrel hold-down shaft 47 which is drivingly connected to the central bore 26 of barrel 17. Shaft 47 is supported in a bushing 48 mounted in a bore 49 in port cap 14. A spring 52 acting through a split collar 51 and a snap ring 50 clamps barrel 17 against port plate 44 which abuts port block 14. Shaft 47 is adjusted axially by a nut 53 which acts on a spacer 54, a thrust bearing 55 and a spacer 56 which engages port block 14.

Figure 3:
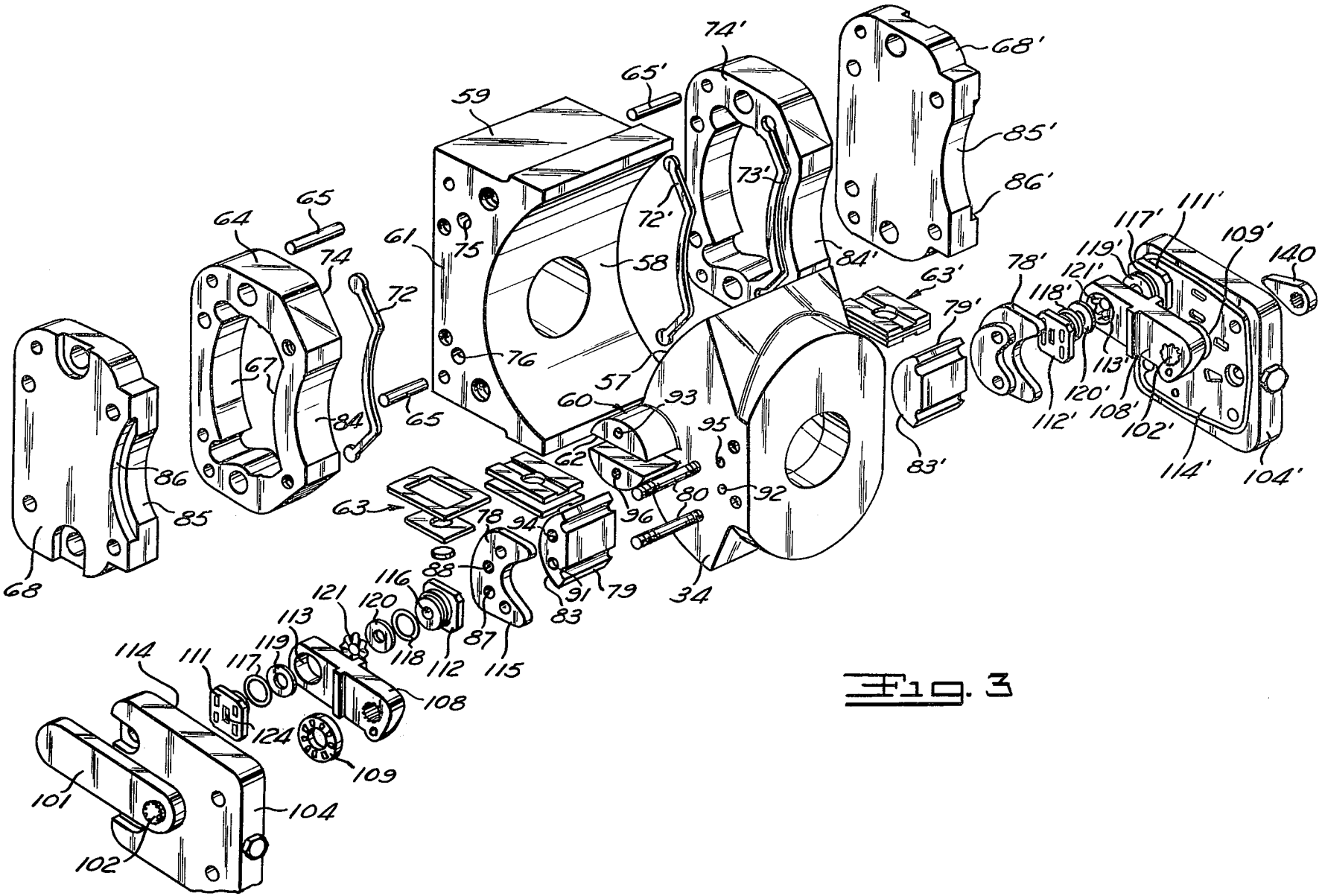
FIG. 3 comprises an exploded view of the control mechanism of the instant invention.
Figure 4:
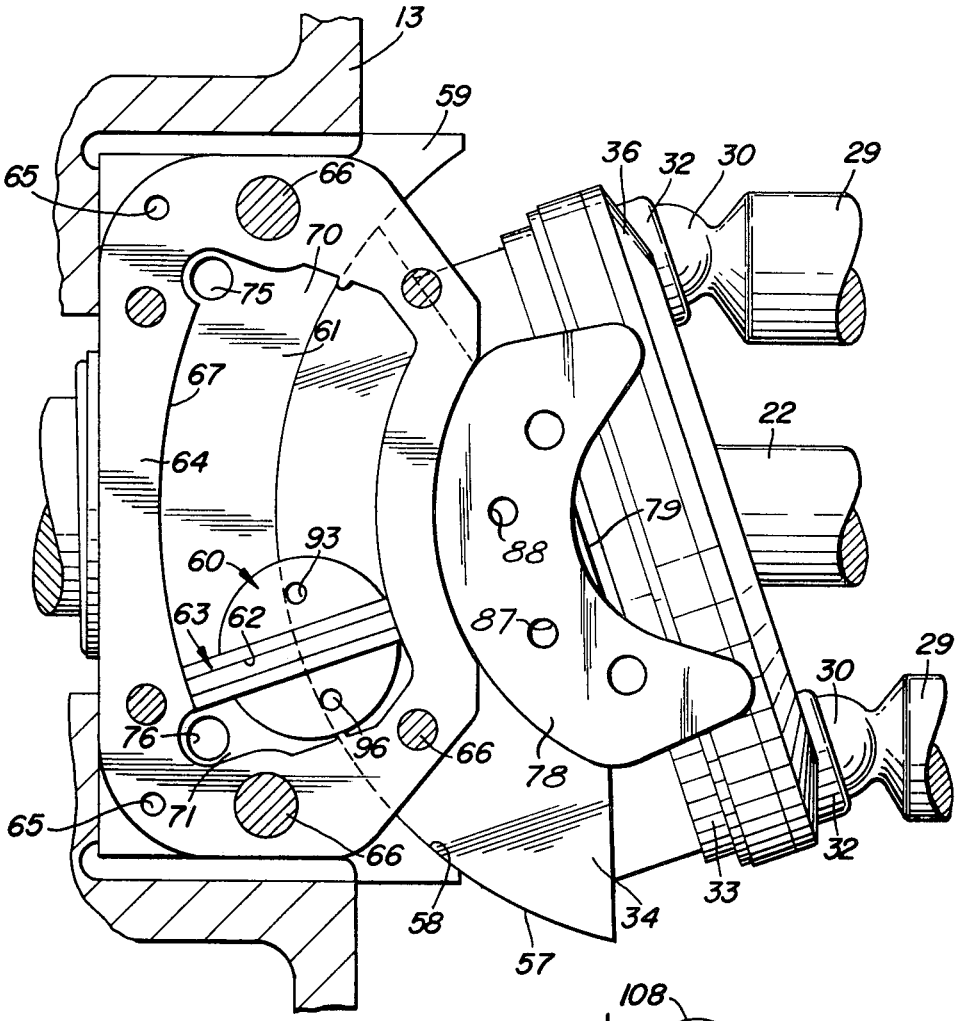
FIG. 4 is an enlarged view of the control mechanism showing the fluid motor which operates to change the position of the thrust plate assembly.
Figure 5:
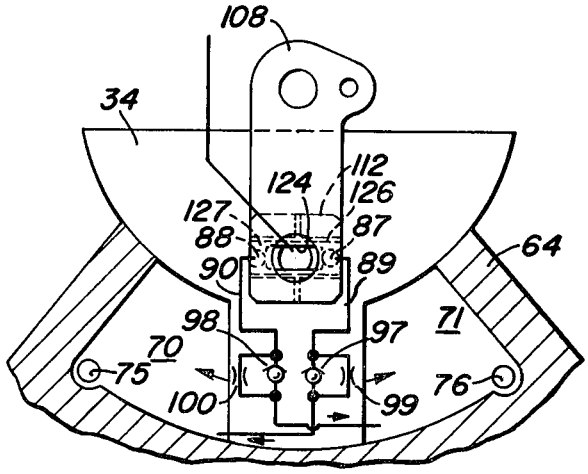
FIG. 5 is a schematic view showing the fluid passages between the valve plate ports and the fluid motor.
Figure 6:
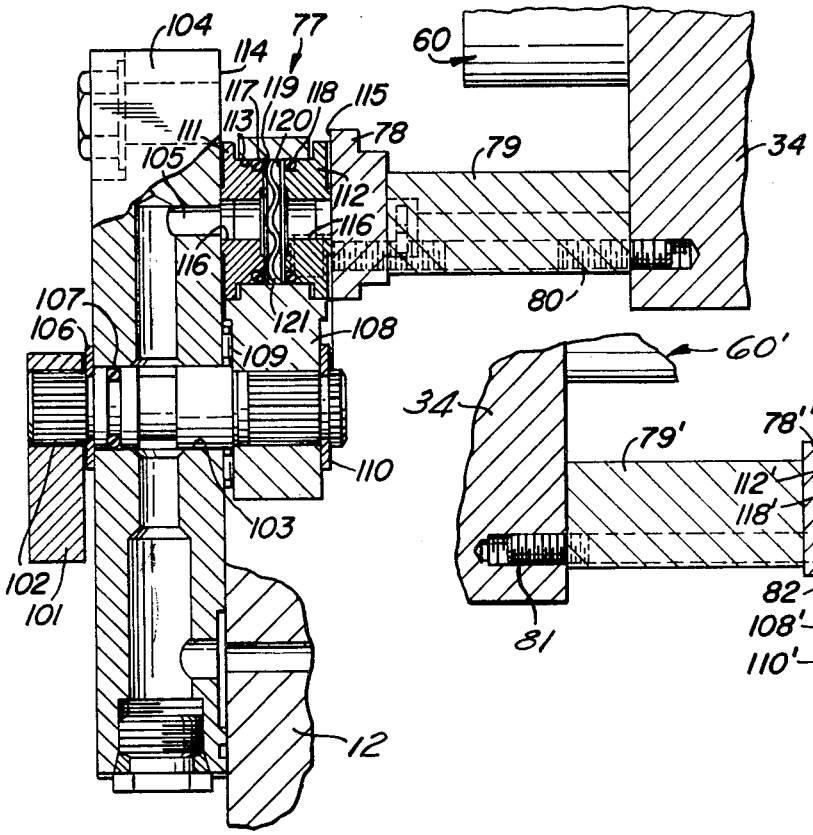
FIG. 6 is an enlarged sectiona view of a portion of the control mechanism showing a valve which controls fluid flow to the fluid motor.
Figure 7:
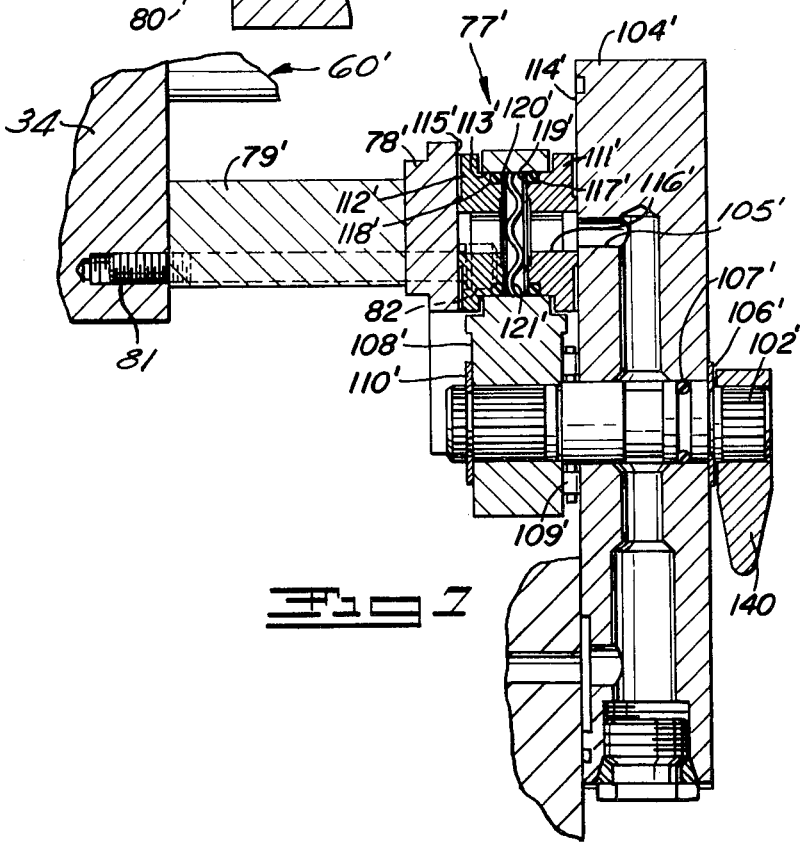
FIG. 7 is an enlarged sectional view of another portion of the control mechanism of FIG. 3 showing a rocker cam position indicator.

Referring to FIGS. 3–5, the pump displacement control mechanism will next be described. The mechanism on each side of rocker cam 34 is substantially the same. Thus, the description will refer to the left side shown in FIGS. 3 and 4 and identical elements on the right side of rocker cam 34 will be indicated by identical primed numbers. Any differences in structure will be explained.

Rocker cam 34 has an arcuate bearing surface 57 which is received in a complementary surface 58 formed on a rocker cam support 59 mounted in end cap 13. Rocker cam 34 pivots about a fixed axis perpendicular to the axis of rotation of barrel 17. Rocker cam 34 could also be trunnion mounted or otherwise supported for pivotal movement. Rocker cam 34 which carries thrust plate 33 is moved relative to support 59 to change pump displacement by a fluid motor which will now be described.

A vane or motor member 60 is formed integrally on the side of the rocker cam 34 so as to be rigidly secured thereto and movable therewith. The vane 60 extends beyond bearing surface 57 to overlie the side 61 of rocker cam support 59 so that the center of vane 60 is at surface 57. The vane 60 could alternatively be rigidly bolted to the rocker cam 34 so that there is no relative movement between the vane 60 (on which the control fluid acts in a manner described below) and the rocker cam 34. The vane 60 has a central slot 62 which receives a seal assembly 63.

A vane housing 64 is located on support 59 by dowel pins 65 and is attached to support 59 by bolts 66. One half of vane housing 64 overlies rocker cam 34 so that vane 60 is received in an arcuate chamber 67 in the housing 64. A cover 68 closes the end of vane housing 64 and is secured by bolts 66. As thus assembled vane 60 and its seal 63 divide chamber 67 into a pair of expansible fluid chambers 70, 71, shown in FIG. 4, to form a fluid motor.

An elastomeric seal 72 fits in a groove 73 on the inner surface 74 of vane housing 64 which abuts rocker cam 34 as best seen in FIG. 3. This provides a dynamic seal for the fluid motor to prevent leakage when rocker cam 34 is pivoted.

Fluid chambers 70, 71 in the fluid motor on one side of rocker cam 34 are connected to fluid chambers in the fluid motor on the other side of rocker cam 34 by passages 75, 76. Consequently, the operation of one motor causes simultaneous operation of the other motor. The two fluid motors apply equal force to the rocker cam 34 and bearing surface 57 remains parallel to surface 58 which reduces the friction therebetween. The fluid motors are operated by supplying pressurized fluid to one of the chambers 70, 71 and exhausting fluid from the other chamber 70, 71 to move vane 60 within chamber 67.

The operation of the fluid motor is controlled by a servo or follow-up control valve mechanism 77 which regulates the supply of pressurized fluid and which includes a fluid receiving valve member. The fluid receiving valve member includes a valve plate 78 and a stem 79 which are mounted on rocker cam 34 by double threaded bolts 80. The fluid receiving valve member and vane 60 move along concentric arcuate paths when rocker cam 34 is moved. Bolts 81, with heads 82, projecting above valve plate 78', mount the valve plate 78' and stem 79' on the right side of rocker cam 34 and function as described hereinafter.

Stem 79 has a curved surface 83 adjacent complementary curved surfaces 84, 85 respectively on housing 64 and cover 68. Plate 78 is partially received in a channel 86 formed in cover 68.

Valve plate 78 has a pair of ports 87, 88 which are connected to the respective fluid chambers 70, 71 in the fluid motor through a pair of passageways 89, 90 (shown schematically in FIG. 5). Passageway 89 includes serially connected bore 91 in stem 79, a bore 92 in rocker cam 34, a drilled opening, not shown, in rocker cam 34 and a bore 93 in vane 60 which opens into fluid chamber 70. Similarly, passageway 90 includes serially connected bore 94 in stem 79, a bore 95 in rocker cam 34, a drilled opening, not shown, in rocker cam 34 and a bore 96 in vane 60 which opens into fluid chamber 71.

For counterclockwise operation of the fluid motor, as viewed in FIG. 5, pressure fluid supplied to port 87 flows through the passageway 89 into chamber 70 to move vane 60 and rocker cam 34 counterclockwise. Expansion of chamber 70 causes chamber 71 to cntract and exhaust fluid through the passageway 90 out of port 88 and into the pump casing.

For clockwise operation of the fluid motor, the fluid flow is reversed. The pressure fluid supplied to port 88 expands chamber 71 to move vane 60 and rocker cam 34 clockwise. Chamber 70 contracts and exhausts fluid through the passageway 89 out of port 87 and into the pump casing.

As seen schematically in FIG. 5, check valves 97, 98 and parallel fluid restricting orifices 99, 100 are located in the passageways 89, 90 connecting ports 87, 88 to chambers 70, 71. This arrangement permits a high fluid flow into an expanding chamber 70, 71 but restricts the rate at which fluid exhausts from the contracting chamber 70, 71 to limit the rate of movement of fluid motor vane 60. The check valves 97, 98 and orifices 99, 100 are positioned in stem 79.

Referring to FIGS. 5–9, that portion of the follow-up control valve mechanism 77 which selectively supplies fluid to the ports 87, 88 in valve plate 78 will now be described. A control handle 101 is attached to an input shaft 102 which is mounted in a bore 103 in a cover plate 104. Cover plate 104 is attached to housing 12 by bolts and includes a fluid port 105 which receives pressure fluid from a source, not shown. Shaft 102 is retained at one end by a snap ring 106 and has a seal 107 which prevents fluid in pump cavity 16 from leaking along shaft 102 to the outside of cover plate 104. An arm 108 is fastened to one end of shaft 102 and slides on a roller bearing 109 sandwiched between the arm 108 and cover plate 104. A snap ring 110 on the inner end of shaft 102 retains arm 108 thereon.

An input valve member includes a pair of identical valve shoes 111, 112 which are received in a bore 113 in arm 108. Shoe 111 rides on a flat inner surface 114 of cover plate 104 and shoe 112 rides on a flat surface 115 on valve plate 78. Each shoe 111, 112 has a central fluid receiving bore 116 which is continuously fed fluid from cover plate port 105. Stop pins, not shown, in cover plate 104 prevent arm 108 from moving shoe 111 out of fluid communication with port 105. O-rings 117, 118 are fitted on the respective shoes 111, 112 to prevent fluid leakage out of bore 113 in arm 108 and to prevent sideways movement of the shoes 111, 112 relative to bore 113 when under pressure. The shoes 111, 112 are free to telescope axially and to tilt in bore 113 for precise parallel alignment with the respective flat surfaces 114, 115. Since shoes 111, 112 can tilt or telescope in bore 113 the surfaces 114, 115 need not be exactly parallel or precisely spaced apart.

The O-rings 117, 118 are covered by respective flat washers 119, 120. A spring washer 121 is interposed between washers 119, 120 to urge them into contact with their respective shoes to thereby maintain O-rings 117, 118 in position against the wall of bore 113 and to urge the shoes 111, 112 into contact with flat surfaces 114, 115.

Figure 8:
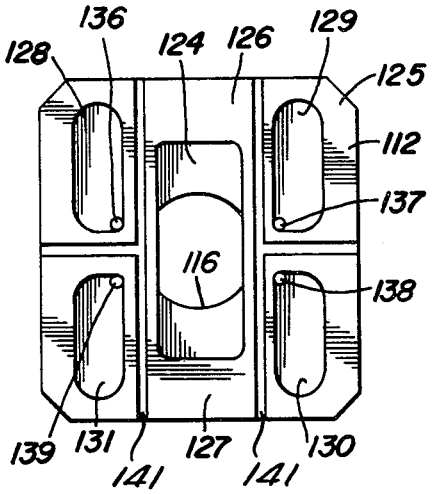
FIGS. 8 and 9 are enlarged views of a valve shoe used in the control valve shown in FIG. 3–7.
Figure 9:
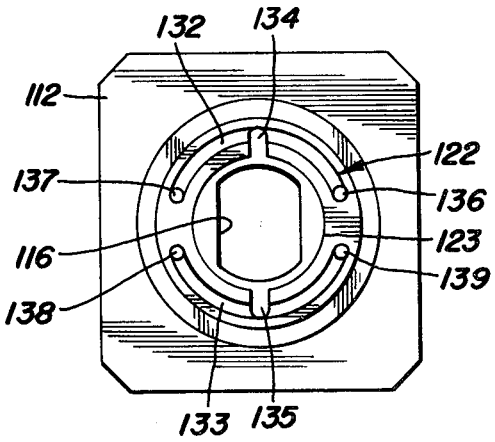

Reference will now be made to FIGS. 8 and 9 to complete the description of shoes 111, 112. O-ring 118 is seated on a shoulder 122. A shallow bore 123 at the top of shoe 112 opens into bore 116 which terminates in a rectangular cavity 124 on a flat bottom surface 125. Flats 126, 127 are located on either side of cavity 124. These flats 126, 127 are of a uniform width equal to the diameter of ports 87, 88. This permits flats 126, 127 to cover ports 87, 88 even though radial position of shoe 112 may vary with respect to valve plate 78.

At the top surface of shoe 112 are a pair of shallow grooves 132, 133 which receive fluid from bore 123 through slots 134, 135 located at the midpoints of the grooves 132, 133 respectively. Groove 132 terminates in bores 136, 137 which open into pockets or cavities 128, 129 respectively. Likewise, groove 133 terminates in bores 138, 139 which open into pockets or cavities 130, 131 respectively. Grooves 132, 133 are covered by the washers 119, 120 respectively which restrict fluid flow through the shallow grooves. Consequently, each cavity 128, 129, 130, 131 is fed a limited amount of fluid from one of the grooves 132, 133 and the fluid supply to each of the cavities is independent of the fluid supply to any other. The cavities 128–131 are isolated from each other by shallow drain groves 141 which surround each cavity and drain fluid which escapes from the cavities 128–131 and also cavity 124.

Shoe 112 is hydraulically lifted from surface 115 so that pressure fluid flows between shoe 112 and surface 115 to thereby create a hydrostatic bearing which reduces the force necessary to move control handle 101 to change the displacement of the pump. The area on top of shoe 112, the perimeter of wich is defined by shoulder 122, is acted upon by pressure fluid to produce a first force which biases shoe 112 inwardly into contact with surface 115. The area on the bottom of shoe 112 defined by cavity 124 is acted upon by pressure fluid to produce a second force which biases shoe 112 outwardly away from surface 115. However, the first force is greater than the second force and the resultant of the two forces is an inward force which biases shoe 112 against surface 115.

The resultant inward biasing force is opposed by a self-modulating third force created by pressure fluid acting on pockets or cavities 128–131 on the bottom of shoe 112. This third force causes shoe 112 to be lifted from surface 115 a predetermined distance.

As shoe 112 lifts off surface 115, fluid in cavities 128–131 escapes therefrom past the surrounding shoe surface, or lands. As the shoe lifts further off surface 115, this peripheral fluid outlet increases in size; hence, the pressure in cavities 128–131 will descrease. Therefore, the third force created by the pressure in these cavities is self-modulating in that the shoes will continue to lift off surface 115 until the pressure in cavities 128–131 decreases to a point where the third force equals, or neutralizes, the resultant force to hydrostatically balance the shoe a predetermined distance off of surface 115. Thus, it can be said that the shoe "floats" on a cushion of fluid which escapes from cavities 128–131 to thereby form a hydrostatic bearing between the shoe and surface 115 and significantly reduce the force required to move the control handle 101 to change the displacement of the pump.

Because shoe 112 is lifted a small amount, some fluid leaks from the bottom of shoe 112 into case 11 at all times. The fluid leakage is nominal, being limited to flow in the restricted passageways or orifices created by shallow grooves 132, 133 and washers 119, 120. Excessive lift off by shoe 112 is prevented since, as the shoe lifts, one or more cavities 128, 129, 130, 131 lose pressure thus reducing the third force below the resultant force which will force shoe 112 against its surface 115 until the third force is regained.

Operation of the fluid motors by control handle 101 will now be described. When the fluid motors are at rest, cavity 124 in valve shoe 112 is between valve plate ports 87, 88 which are covered by flats 126, 127 on valve shoe 112. To change the displacement of the pump, control handle 101 is moved in the direction rocker cam 34 is to pivot. Thus if handle 101 is moved clockwise as viewed from the left in FIG. 5, this moves shoe 112 clockwise and places cavity 124 (which is in fluid communication with port 105 under all conditions) in fluid communication with port 88 while uncovering port 87. Pressure fluid flows from cavity 124 into port 88, through the passageway 90, and into chamber 71. Simultaneously, fluid exhausts from chamber 70 through passageway 89 and out uncovered port 87 to pivot rocker cam 34 clockwise as described above. Rocker cam 34 is pivoted counterclockwise in a similar manner if handle 101 is moved counterclockwise and cavity 124 is placed in fluid communication with port 87.

Accurate follow-up is provided since angular movement of rocker cam 34 and valve plate 78 is equal to that of control handle 101. When rocker cam 34 and valve plate 78 have moved through the same angle as control handle 101, cavity 124 is centered between ports 87, 88, flats 126, 127 on shoe 112 cover ports 87, 88 and the fluid motors stop.

The control mechanism 77 provides for full range storage, i.e. regardless of the position of rocker cam 34, control handle 101 can be moved immediately to another position. Even if rocker cam 34 is at one extreme limit of its travel, control handle 101 can be moved to the position of the other extreme limit and rocker cam 34 will follow.

The full error storage is possible since the length of cavity 124 in shoe 112 is slightly greater than the distance between ports 87, 88 and port plate 78 is extended beyond ports 87, 88 so cavity 124 does not run off of plate 78. Cavity 124 is always in fluid communication with one of the ports 87, 88 to operate the fluid motor to drive rocker cam 34 in the direction of control handle 101 when handle 101 is out of the null position.

The mechanism on the right side of rocker cam 34 shown in FIG. 3 has a pointer 140 in place of control handle 101 on the left side. Bolt heads 82 which secure valve plate 78' and stem 79' to rocker cam 34 capture arm 108' and force it to move when cam 34 is moved. This moves pointer 140 to indicate the exact angular position of rocker cam 34.

Pressure fluid, from a source not shown, flows through port 105' in cover plate 104' to valve shoes 111', 112' in the valve mechanism 77' on the right side shown in FIG. 3. The pressure fluid hydrostatically balances shoes 111', 112' in the same manner shoes 111, 112 are balanced. In this way, the hydraulic force applied laterally to valve plate 78 to pressure balance shoes 111, 112 is counterbalanced by an equal and opposite force applied to valve plate 78' to pressure balance shoes 111', 112' to thereby balance the lateral forces on rocker cam 34. Since the valve mechanism 77' is an indicator device and does not control the fluid motors, there are no fluid passageways in valve plate 78' or stem 79'. Plate 78' is only used for counterbalancing purposes.

Obviously, those skilled in the art may make various changes in the details and arrangements of parts without departing from the spirit and scope of the invention as it is defined by the claims hereto appended. Applicant, therefore, wishes not to be restricted to the precise construction herein disclosed.

Having thus described and shown one embodiment of the invention, what is desired to secure by Letters Patent of the United States is:

1. A control device for a fluid motor having a movable fluid motor member, comprising an input member for setting the desired position of said fluid motor, a valve shoe having a pressure fluid supply port and carried by said input member, a flat valve plate having a pair of fluid receiving ports, passage means for connecting both of said fluid receiving ports to said fluid motor, said input member being alternatively movable between a first position in which said fluid supply port is aligned with one of said fluid receiving ports to thereby move said movable fluid motor member in one direction, a second position in which said fluid supply port is aligned with the other of said fluid receiving ports to thereby move said movable fluid motor member in another direction and a null position in which said fluid supply port is misaligned with both of said fluid receiving ports and said fluid motor is inoperative, said valve plate being movable in direct response to movement of said movable fluid motor member to misalign said fluid receiving ports and said fluid supply port when said fluid motor reaches the position set by said input member, and differential area means on said valve shoe responsive to fluid pressure to move said shoe away from said valve plate a predetermined distance to permit limited fluid flow therebetween and thus create a hydrostatic bearing.

2. A control valve for controlling pressure fluid, comprising a flat valve plate having a pair of fluid receiving ports, an input member, a valve shoe having a fluid supply port carried by said input member and slidable on said valve plate, said input member alternatively movable between a first position in which said fluid supply port is aligned with one of said fluid receiving ports, a second position in which said fluid supply port is aligned with the other of said fluid receiving ports, and a null position in which said fluid supply port is misaligned with both of said fluid receiving ports, means biasing said valve shoe toward said valve plate, and self-modulating pressure responsive means opposing said biasing means to move said shoe away from said valve plate a predetermined distance to permit fluid flow therebetween and thus create a hydrostatic bearing said self-modulating pressure responsive means includes a plurality of fluid receiving pockets formed in said shoe adjacent said valve plate, means for supplying pressure fluid to each of said pockets including a fixed orifice, and variable outlet means automtically adjustable to regulate the pressure of the supply fluid in said pockets to move the shoe relative to the valve plate such that said predetermined distance is maintained.

3. The control valve recited in claim 2, wherein the outlet means comprise the valve plate surface and lands on the shoe surrounding said pockets, the pressure in each pocket being an inverse function of the distance between its lands and the plate surface, whereby the shoe will lift off the plate until the forces produced by the pressures in the pockets neutralize said biasing force.

4. The control device recited in claim 2, wherein the fixed orifice includes a shallow groove on the top surface of the shoe, a flat washer covering the groove to restrict fluid flow therethrough, a fluid passage connecting the shallow groove to one of said pockets and said shallow groove is connected to a source of pressure fluid.

5. A control valve for controlling pressure fluid, comprising a flat valve plate having a pair of fluid receiving ports, an input member, a valve shoe having a fluid supply port carried by said input member and slidable on said valve plate, said input member alternatively movable between a first position in which said fluid supply port is aligned with one of said fluid receiving ports, a second position in which said fluid supply port is aligned with the other of said fluid receiving ports, and a null position in which said fluid supply port is misaligned with both of said fluid receiving ports, means biasing said valve shoe toward said valve plate, and self modulating pressure responsive means opposing said biasing means to move said shoe away from said valve plate a predetermined distance to permit fluid flow therebetween and thus create a hydrostatic bearing, said biasing means comprises a first area on said shoe responsive to fluid pressure to create a first force biasing the shoe away from said plate and a second area on said shoe responsive to fluid pressure to create a second force biasing said shoe toward said plate, the sum of the first and second forces comprising a resultant force biasing said shoe toward the valve plate and said self-modulating pressure responsive means include a third area means, means restricting the flow of pressure fluid to said third area means, and variable outlet means from said third area means, said third area means being responsive to fluid pressure to create a third force to oppose said resultant force and move said shoe away from said valve plate until said third force equals said resultant force.

6. The control valve recited in claim 5, wherein said third area means comprises a plurality of spaced pockets formed in said flat surface, said restricting means comprises a fixed orifice for supplying pressure fluid to each of said pockets, and said variable outlet means comprises lands on the shoe periphery surrounding said pockets and the adjacent valve plate surface which creates a fluid outlet from said third area means which varies in size as the shoe moves away from the plate, wherein pressure in each recess varies inversely with the distance its adjacent land is spaced from said valve plate to thereby cause an unbalance of pressure in said pockets to create a corrective force opposing an externaly applied force tending to tilt said valve shoe relative to said valve plate.

7. A control device for a fluid motor having a movable fluid motor member, comprising an input member for setting the desired position of said fluid motor, a flat valve plate having a pair of fluid receiving ports, a valve shoe mounted in a bore in the input member and positioned between the input member and the valve plate wherein the valve shoe is axially movable and tiltable in the bore to accommodate variations in parallelism and distance between the input member and the valve plate, a pressure fluid supply port opening into a flat surface in said valve shoe adjacent said valve plate, a source of pressure fluid, passage means for connecting both of said fluid receiving ports to said fluid motor, said input member being alternatively movable between a first position in which said fluid supply port is aligned with one of said fluid receiving ports to thereby move said movable fluid motor member in one direction, a second position in which said fluid supply port is aligned with the other of said fluid receiving ports to thereby move said movable fluid motor member in another direction and a null position in which said fluid supply port is misaligned with both of said fluid receiving ports and said fluid motor is inoperative, said valve plate being movable in direct response to movement of said movable fluid motor member to misalign said fluid receiving ports and said fluid supply port when said fluid motor reaches the position set by said input member, and differential area means on said valve shoe responsive to fluid pressure to move said shoe away from said valve plate a predetermined distance to permit limited fluid flow therebetween and hydrostatically balance the shoe.

8. The control device recited in claim 7, including means for simultaneously biasing said first valve shoe against said housing flat surface and said second valve shoe against said second flat surface on said valve plate.

9. The control device recited in claim 7, including means for sealing said first valve shoe in the first said bore to prevent fluid leakage therebetween and second means for sealing said second valve shoe in the first said bore to prevent fluid leakage therebetween.

10. A control device for a fluid motor having a movable fluid motor member, comprising an input member for setting the desired position of said fluid motor, means for pivotally attaching the input member to a housing, a manual control arm for pivoting the input member, a first valve shoe mounted in a bore in the input member between the input member and the housing, a flat surface on said first valve shoe adapted to slide on a flat surface on said housing, said first valve shoe adapted to move axially and tilt in said bore to accommodate variations in parallelism and distance between the input member and the housing, a first fluid supply port in said housing which opens into the flat surface of the housing adjacent the first valve shoe, a source of pressure fluid for said first fluid supply port, a second bore in the first valve shoe in fluid communication with said first fluid supply port, a flat valve plate having a pair of fluid receiving ports, a second valve shoe mounted in the bore in the input member and positioned between the input member and the valve plate, a second flat surface on said second valve shoe adapted to slide on said flat valve plate, said second valve shoe adapted to move axially and tilt in the first said bore to accommodate variations in parallelism and distance between said input member and said valve plate, a third bore in the second valve shoe in fluid communication with said second bore for receiving said pressure fluid, a second pressure fluid supply port opening into said second flat surface in said second valve shoe adjacent said valve plate, passage means for connecting both of said fluid receiving ports in the valve plate to said fluid motor, said input member being alternatively movable between a first position in which said second pressure fluid supply port is aligned with one of said fluid receiving ports to thereby move said movable fluid motor member in one direction, a second position in which said second pressure fluid supply port is aligned with the other of said fluid receiving ports to thereby move said movable fluid motor member in another direction and a null position in which said second pressure fluid supply port is misaligned with both of said fluid receiving ports and said fluid motor is inoperative, said valve plate being movable in direct response to movement of said movable fluid motor member to misalign said fluid receiving ports and said second pressure fluid supply when said fluid motor reaches the position set by said input member, and differential area means on said second valve shoe responsive to fluid pressure to move said second shoe away from said valve plate a predetermined distance to permit limited fluid flow therebetween and hydrostatically balance the shoe.

* * * * *

UNITED STATES PATENT OFFICE

CERTIFICATE OF CORRECTION

PATENT NO. : 4,056,041

DATED : November 1, 1977

INVENTOR(S) : Ellis H. Born, William H. Meisel, Alan H. Viles

It is certified that error appears in the above-identified patent and that said Letters Patent are hereby corrected as shown below:

Col. 1, line 60 - "linkage" should read --linkages--

Col. 2, line 31 - "sectiona" should read --sectional--

Col.10, line 59 - after "supply" insert --port--
(Claim 10)

Col.10, Claims 8 and 9 should depend from claim 10.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*